US006878215B1

(12) United States Patent
Zimmerman, Jr.

(10) Patent No.: US 6,878,215 B1
(45) Date of Patent: Apr. 12, 2005

(54) CHEMICAL REMOVAL OF A METAL OXIDE COATING FROM A SUPERALLOY ARTICLE

(75) Inventor: Robert G. Zimmerman, Jr., Morrow, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/857,732

(22) Filed: May 27, 2004

(51) Int. Cl.[7] ..... B08B 3/04

(52) U.S. Cl. ..... 134/26; 134/2; 134/6; 134/19; 134/27; 134/29; 134/30; 134/36; 134/37; 134/42

(58) Field of Search ..... 134/2, 6, 19, 26, 134/27, 29, 30, 36, 37, 42

(56) References Cited

U.S. PATENT DOCUMENTS

| | | | | |
|---|---|---|---|---|
| 3,553,015 | A | | 1/1971 | Dohogne |
| 3,615,825 | A | | 10/1971 | Gansser |
| 3,622,391 | A | | 11/1971 | Baldi |
| 3,833,414 | A | | 9/1974 | Grisik et al. |
| 3,954,648 | A | | 5/1976 | Belcak et al. |
| 4,098,450 | A | | 7/1978 | Keller et al. |
| 4,188,237 | A | | 2/1980 | Chasteen |
| 4,317,685 | A | | 3/1982 | Ahuja et al. |
| 4,328,044 | A | | 5/1982 | Chasteen |
| 4,439,241 | A | | 3/1984 | Ault et al. |
| 4,525,250 | A | | 6/1985 | Fahrmbacher-Lutz et al. |
| 4,655,383 | A | | 4/1987 | Fournes et al. |
| 4,713,120 | A | | 12/1987 | Hodgens, II et al. |
| 4,944,807 | A | | 7/1990 | Sova |
| 4,965,095 | A | | 10/1990 | Baldi |
| 4,975,147 | A | | 12/1990 | Tahara et al. |
| 5,071,486 | A | | 12/1991 | Chasteen |
| 5,112,572 | A | | 5/1992 | Eerkes et al. |
| 5,248,381 | A | | 9/1993 | Dunker et al. |
| 5,290,365 | A | | 3/1994 | Whitton |
| 5,330,558 | A | | 7/1994 | McCormick et al. |
| 5,643,474 | A | | 7/1997 | Sangeeta |
| 5,679,170 | A | | 10/1997 | Frenier |
| 5,763,377 | A | | 6/1998 | Dobrez et al. |
| 5,976,265 | A | | 11/1999 | Sangeeta et al. |
| 6,132,520 | A | | 10/2000 | Schilbe et al. |
| 6,146,692 | A | | 11/2000 | Sangeeta et al. |
| 6,158,957 | A | | 12/2000 | Marcin et al. |
| 6,174,380 | B1 | | 1/2001 | Rosenzweig et al. |
| 6,217,668 | B1 | | 4/2001 | Czech et al. |
| 6,267,902 | B1 | | 7/2001 | Cartier et al. |
| 6,355,116 | B1 | | 3/2002 | Chen et al. |
| 6,367,686 | B1 | | 4/2002 | Abriles et al. |
| 6,416,589 | B1 | | 7/2002 | Lipkin et al. |
| 6,454,870 | B1 | * | 9/2002 | Brooks ..... 134/3 |
| 6,536,135 | B2 | | 3/2003 | Lipkin et al. |
| 2001/0009246 | A1 | * | 7/2001 | Zimmerman et al. ..... 216/34 |
| 2002/0100493 | A1 | | 8/2002 | Kool et al. |
| 2004/0074873 | A1 | * | 4/2004 | Kool et al. ..... 216/109 |

OTHER PUBLICATIONS

Turco Alkaline Rust Remover, Material Safety Data Sheet, Atofina Chemicals, Inc., Jun. 16, 2000, USA.

* cited by examiner

*Primary Examiner*—Sharidan Carrillo
(74) *Attorney, Agent, or Firm*—Daniel F. Nesbitt; Hasse & Nesbitt LLC

(57) ABSTRACT

A method of removing a virgin metal oxide coating from the surface of a superalloy gas turbine engine component. The component bearing the applied metal oxide coating is contacted with an aqueous coating-removal solution, typically containing by weight about 10–25% alkali hydroxide, about 1–8% alkanolamine, and about 0.5–5% gluconate salt at a temperature of from about 170° F. (67° C.) to about 210° F. (99° C.), for a time sufficient to remove the metal oxide coating from the superalloy blade by gentle mechanical means. The metal oxide coating can comprise one or more metal oxide layers, such as a chromium oxide layer and an aluminum oxide layer.

13 Claims, No Drawings

CHEMICAL REMOVAL OF A METAL OXIDE COATING FROM A SUPERALLOY ARTICLE

BACKGROUND OF THE INVENTION

This invention relates to the removal of a metal oxide coating from a superalloy article.

In an aircraft gas turbine (jet) engine, air is drawn into the front of the engine and compressed by an axial-flow compressor. The axial-flow compressor includes a number of compressor stages. Each compressor stage has a plurality of compressor blades mounted to a compressor disk, which in turn is mounted to a rotating shaft.

In many early versions of gas turbine engines, the compressor blades were made of an uncoated metal. As the technology of gas turbine engines has advanced and the temperatures of operation have increased, it has become necessary to coat the compressor blades to inhibit oxidation of the metal during extended service. The coatings need not be as protective and as resistant to the effects of the combustion gas at high temperatures as the environmental coatings and thermal barrier coatings used on the turbine blades, but they must provide oxidation protection at intermediate temperatures. Chromium and aluminum oxide coatings cured in the presence of an inorganic binder have been selected for use to coat the compressor blades of the high pressure compressor stages of some engines.

The application of metal oxide coatings onto compressor blades, high pressure turbine disks and seals, and other components of gas turbine engines should meet specific standards to ensure proper performance of the metal oxide coating on the component over and extended service life. When the application is not properly applied according to the specification, or a flaw in the application process occurs, the metal oxide coating is usually completely removed from article down to the base metal, before re-application of the oxide coating.

A chemical method is preferred for removing initially-applied oxide coatings from superalloy compressor blades, high pressure turbine disks and seals, other component of a gas turbine engine. The present invention provides an improved process for removing an oxide coating from a gas turbine engine component.

SUMMARY OF THE INVENTION

The present invention relates to a method of removing a metal oxide coating from a superalloy article, comprising the steps of: 1) providing a superalloy article having a surface, and at least one oxide coating on the surface; wherein the superalloy article has not been used at operating conditions in a gas turbine engine; and 2) contacting the article with an aqueous coating-removal solution at a temperature of from about 170° F. (77° C.) to about 210° F. (99° C.), for a time sufficient to remove the oxide coating from the superalloy article by gentle mechanical means, the coating-removal solution comprising by weight: a) about 10–25% alkali hydroxide, b) about 1–8% alkanolamine, and c) about 0.5–5% gluconate salt.

DETAILED DESCRIPTION OF THE INVENTION

The present invention provides a technique for removing an oxide coating from a superalloy article. The present approach can be applied to a wide variety of superalloy articles onto which the metal oxide coating is advantageously applied that can include superalloy compressor blades, and high pressure turbine disks and seals. The invention is useful for removing metal oxide layers that have not been properly applied according to a specification, or have a flaw in the layer following the application process. The invention provides a composition for use in a single chemical treatment step that can completely remove the metal oxide coating from the article down to the base metal, before re-application of the oxide coating.

In a first embodiment of the present invention, the method provides for removing a virgin oxide coating from a superalloy article used in a gas turbine engine, prior to use of the article in an operating environment that would expose the article to high temperatures. The present approach is based primarily on chemical cleaning, without the use of grit or bead blasting. The present method provides chemical removal of one or more virgin metal oxide coatings, without the use of grit or bead blasting, and relatively gentle on the underlying base metal of the article. The embodiment contemplates that the metal oxide layers are substantially "as-applied" or virgin, meaning that they oxide layers and coating have not been exposed to high temperatures, such as those experienced in normal engine operations, which can cure and set the oxide coating layers. The invention does not contemplate the removal of metal oxide coatings after the article has been exposed to engine operation temperatures.

In a typical application that can employ the present invention, one or more metal oxide coating or sealer layers can be deposited upon the surface of the superalloy substrate during its manufacture or refurbishment. In the event that any one or more of the layers has been applied and must be removed from the substrate, prior to use of the article, the metal oxide coatings can be removed from the article by contacting the article, in a first step, with a coating-removal solution for a time sufficient to remove the one or more oxide coating from the superalloy article by gentle mechanical means. The coating removal solution is typically held at a temperature of from about 170° F. (77° C.) to about 210° F. (99° C.). Typically, the step of contacting the article with the solution is for at least about 1 hour, and more typically from about 1 hour to about 2 hours.

The coating-removal solution comprises by weight a) about 10–25% alkali hydroxide, b) about 1–8% alkanolamine, and c) about 0.5–5% alkali gluconate. The alkanolamine can be selected from the group consisting of a dialkanolamine, a trialkanolamine, and a mixture thereof. The dialkanolamine can comprise diethanolamine, dipropanolamine, diisopropanolamine, ethanolpropanolamine, bis(aminoethyl)amine, bis (aminopropyl)amine, and is typically diethanolamine. The trialkanolamine can comprise triethanolamine, tripropanolamine, trimethanolamine, diethanolpropanolamine, dimethylethanolamine, dimethylpropanolamine, and tributanolamine, and is typically triethanolamine. A typical alkanolamine comprises a mixture of diethanolamine and triethanolamine.

The gluconate can be selected from alkali gluconate and alkali metal gluconate, and is typically alkali gluconate. The alkali salts can be sodium, potassium, and lithium, and is typically sodium. The alkali metal salts can be calcium and magnesium.

The coating-removal solution more typically comprises about 12–20% alkali hydroxide, about 1.5–5% alkanolamine, and about 1–3% gluconate. The coating-removal solution can be made by combining individual chemical compounds in water, or by dilution of a concentrate product with from about 1 part to 10 parts water, more typically from about 3 parts to 5 parts water. One preferred concentrate product comprises 65–75% sodium hydroxide, 5–15% triethanolamine, 2–5% diethanolamine, and about 5–10% sodium gluconate, and is available in a dry product form as Turco® T-4181, or in a more diluted liquid product form as Turco® T4181L, from Turco Products, Inc., a division of Henkel Surface Technologies of Madison Heights, Mich.

The surface of the article is thereafter examined visually. If any trace of the metal oxide coating remains, the first step can be repeated, until none of the metal oxide coating is observed.

The article is removed from the coating-removal solution, and, in a second step b), rinsed by spraying with a water jet or immersion in water, typically at room temperature. If loose metal oxide coating residue is observed on the surface of the article, the rinsing can be accomplished instead or additionally in deionized water at a minimum temperature of 160° F. (71° C.). Loose residue on the surface can also be removed by brushing the surface of the article with a nonmetallic, soft-bristle brush or a nonmetallic pad such as a Scotch Brite® pad.

The surface of the article can thereafter be prepared for re-application of one or more metal oxide coatings.

The present invention has been practiced on high pressure turbine disks and seals having a virgin three-layer coating. The base metal of the substrate was Rene' 88 DT alloy. The first layer was an aluminum oxide in a chromate-phosphate inorganic binder, designated as Sermetel 1718, available from Sermetech. The second layer was a chromium oxide in the inorganic binder, designated Sermaseal 1076HS, available from Sermetech. The third layer was a chromate-phosphate sealer, designated as Sermaseal 565, also available from Sermetech. The method of the invention effectively removed the virgin three-layer coating.

Without being bound by any theory, it is believed that the coating-removal solution attacks the binder system in the metal oxide coating, causing the layers of the coating to release from the surface of the alloy substrate. Once released from the substrate, the aluminum oxide coating can be gently removed with water and/or nylon brushing.

The present coating-removal process does not mechanically alter the surface of the article, so that subsequent inspections of the article are not impeded. The only mechanical processing of the surface is the optional gentle brushing.

Although a particular embodiment of the invention has been described in detail for purposes of illustration, various modifications and enhancements may be made without departing from the spirit and scope of the invention. Accordingly, the invention is not to be limited except as by the appended claims.

I claim:

1. A method of removing a metal oxide coating from a superalloy article, comprising the steps of:

1) providing a superalloy article having a surface, and at least one oxide coating on the surface; wherein the superalloy article has not been used at operating conditions in a gas turbine engine; and 2) contacting the article with an aqueous coating-removal solution at a temperature of from about 170° F. (77° C.) to about 210° F. (99° C.), for a time sufficient to remove the oxide coating from the superalloy article by mechanical means, the coating-removal solution comprising by weight:

a) about 10–25% alkali hydroxide, b) about 1–8% alkanolamine, and c) about 0.5–5% gluconate salt.

2. The method according to claim 1 wherein the oxide coating is selected from the group consisting of an aluminum oxide coating, a chromium oxide coating, and mixtures thereof.

3. The method according to claim 1, wherein the oxide coating comprises a plurality of oxide coating layers, selected from an aluminum oxide coating and a chromium oxide coating.

4. The method according to claim 1 wherein the step of contacting the article with the solution is for at least about 1 hour.

5. The method according to claim 1 wherein the alkanolamine is selected from the group consisting of dialkanolamine, trialkanolamine and mixtures thereof.

6. The method according to claim 1 wherein the alkanolamine is selected from the group consisting of a diethanolamine, a triethanolamine, and a mixture thereof.

7. The method according to claim 1 further comprising the step of rinsing the article.

8. The method according to claim 1 wherein the coating-removal solution, by weight, comprises about 12–20% alkali hydroxide, about 1.5–5% alkanolamine, and about 1–3% gluconate salt.

9. The method according to claim 1 wherein the article is selected from a compressor blade, a high pressure turbine disk, and a high pressure turbine seal.

10. The method according to claim 5 wherein the alkanolamine comprises a mixture of dialkanolamine and trialkanolamine.

11. The method according to claim 7 wherein the mechanical means comprises a brushing of the rinsed article with a nylon brush.

12. The method according to claim 8 wherein the alkanolamine comprises a mixture of diethanolamine and triethanolamine, and the gluconate salt comprises sodium gluconate.

13. The method according to claim 10 wherein the dialkanolamine comprises diethanolamine and the trialkanolamine comprises triethanolamine.

* * * * *